US011408113B2

(12) United States Patent
Leibman et al.

(10) Patent No.: US 11,408,113 B2
(45) Date of Patent: Aug. 9, 2022

(54) WASHING MACHINE FLUID ADDITIVE DISPENSER WITH MULTIPLE TIME-DELAYED DISPENSING CUPS

(71) Applicant: Haier US Appliance Solutions, Inc., Wilmington, DE (US)

(72) Inventors: Alexander B. Leibman, Prospect, KY (US); Kalyana Mallavarapu, Hyderabad (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 174 days.

(21) Appl. No.: 16/839,442

(22) Filed: Apr. 3, 2020

(65) Prior Publication Data

US 2021/0310177 A1 Oct. 7, 2021

(51) Int. Cl.
*D06F 39/02* (2006.01)
*D06F 23/04* (2006.01)

(52) U.S. Cl.
CPC ..... *D06F 39/022* (2013.01); *D06F 23/04* (2013.01); *D06F 39/028* (2013.01)

(58) Field of Classification Search
None
See application file for complete search history.

(56) References Cited

U.S. PATENT DOCUMENTS 5,359,744 A * 11/1994 Kimball ..... D06F 39/024 8/158
8,336,227 B2 12/2012 Bae
8,695,232 B2 4/2014 Bae
9,863,083 B2 1/2018 Leibman et al.
9,963,819 B2 5/2018 Leibman et al.
2009/0211109 A1 8/2009 Choi et al.
2017/0268152 A1* 9/2017 Leibman ..... D06F 39/022
2017/0350061 A1* 12/2017 Ramasco ..... D06F 39/022
2019/0017215 A1* 1/2019 Gonzaga ..... D06F 13/00

FOREIGN PATENT DOCUMENTS

| | | | |
|---|---|---|---|
| CA | 2485865 | C | 8/2007 |
| CA | 2478756 | C | 10/2010 |
| CN | 101629379 | B | 1/2010 |
| DE | 112007003791 | B4 | 11/2018 |
| EP | 1445367 | B1 | 2/2010 |
| EP | 2041358 | B1 | 9/2010 |
| EP | 2519677 | B1 | 4/2015 |
| EP | 1564325 | B1 | 4/2018 |
| ES | 2460067 | T3 | 5/2014 |
| KR | 100662364 | B1 | 1/2007 |
| KR | 100765278 | B1 | 10/2007 |
| KR | 101253181 | B1 | 4/2013 |
| KR | 101341461 | B1 | 12/2013 |
| WO | WO2008013382 | A2 | 1/2008 |
| WO | WO2008129028 | A1 | 10/2008 |

* cited by examiner

*Primary Examiner* — Cristi J Tate-Sims
(74) *Attorney, Agent, or Firm* — Dority & Manning, P.A.

(57) ABSTRACT

A washing machine appliance and a fluid additive dispenser therefor are provided. The washing machine appliance includes a wash tub and a wash basket rotatably mounted within the wash tub. The fluid additive dispenser includes a reservoir defining a first cup for a first additive and an outlet in fluid communication with the wash basket. The fluid additive dispenser also includes a second cup for a second additive. The second cup is disposed within the first cup and separated from the first cup. The second cup is also in fluid communication with the wash basket via the outlet of the first cup.

20 Claims, 5 Drawing Sheets

WASHING MACHINE FLUID ADDITIVE DISPENSER WITH MULTIPLE TIME-DELAYED DISPENSING CUPS

FIELD OF THE INVENTION

The present subject matter relates generally to fluid additive dispensers for appliances, e.g., washing machine appliances.

BACKGROUND OF THE INVENTION

Washing machine appliances generally form a wash fluid to clean clothing articles disposed within a wash basket of the appliance. The wash fluid can include water and various fluid additives, e.g., detergent, fabric softener, and/or bleach. The fluid additives can be mixed with water within a wash tub of the appliance in order to form the wash fluid.

To introduce fluid additives into the wash tub, a user can manually add the fluid additive to the wash tub and/or the wash basket. For example, after starting the appliance, the user can pour detergent directly into the wash basket. Conversely, certain washing machine appliances include features for receiving fluid additives and dispensing the fluid additives during operation of the appliance. For example, a tray or container mounted to a top panel of a vertical axis washing machine appliance can receive a fluid additive and direct the fluid additive into a wash tub of the appliance. Similarly, a horizontal axis washing machine appliance can include a drawer with a container mounted therein that receives a fluid additive and directs the fluid additive into a wash tub of the appliance.

The containers described above may sometimes provide a time-delay functionality, whereby additive may be stored in a reservoir of the container prior to a wash cycle and the washing machine appliance may be configured to add water to the reservoir at a desired time during the wash cycle until the additive and water mixture are drawn from the reservoir, e.g., by a siphon valve. However, such time-delay functionality is typically only provided for a single additive, or multiple reservoirs and/or multiple water sources (e.g., multiple water lines and/or valves) are required to provide a time-delay functionality for each additive of multiple additives.

Accordingly, a washing machine appliance with features for improved handling of multiple fluid additives would be useful.

BRIEF DESCRIPTION OF THE INVENTION

Aspects and advantages of the invention will be set forth in part in the following description, or may be apparent from the description, or may be learned through practice of the invention.

In one exemplary embodiment, a washing machine appliance is provided. The washing machine appliance includes a cabinet defining a vertical direction. The cabinet has a top panel that defines an opening. A wash tub is mounted within the cabinet and is configured for containing fluid during operation of the washing machine appliance. A wash basket is rotatably mounted within the wash tub. A fluid additive dispenser is positioned adjacent the wash tub and the wash basket. The fluid additive dispenser includes a first cup defining a first reservoir for a first additive and an outlet in fluid communication with the wash basket. The fluid additive dispenser also includes a second cup defining a second reservoir for a second additive. The second cup is disposed within the first cup. The second reservoir is separated from the first reservoir. The second reservoir is also in fluid communication with the wash basket via the outlet of the first cup.

In another exemplary embodiment, a fluid additive dispenser for a washing machine appliance is provided. The fluid additive dispenser includes a first cup defining a first reservoir for a first additive and an outlet in fluid communication with the wash basket. The fluid additive dispenser also includes a second cup defining a second reservoir for a second additive. The second cup is disposed within the first cup. The second reservoir is separated from the first reservoir. The second reservoir is also in fluid communication with the wash basket via the outlet of the first cup.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
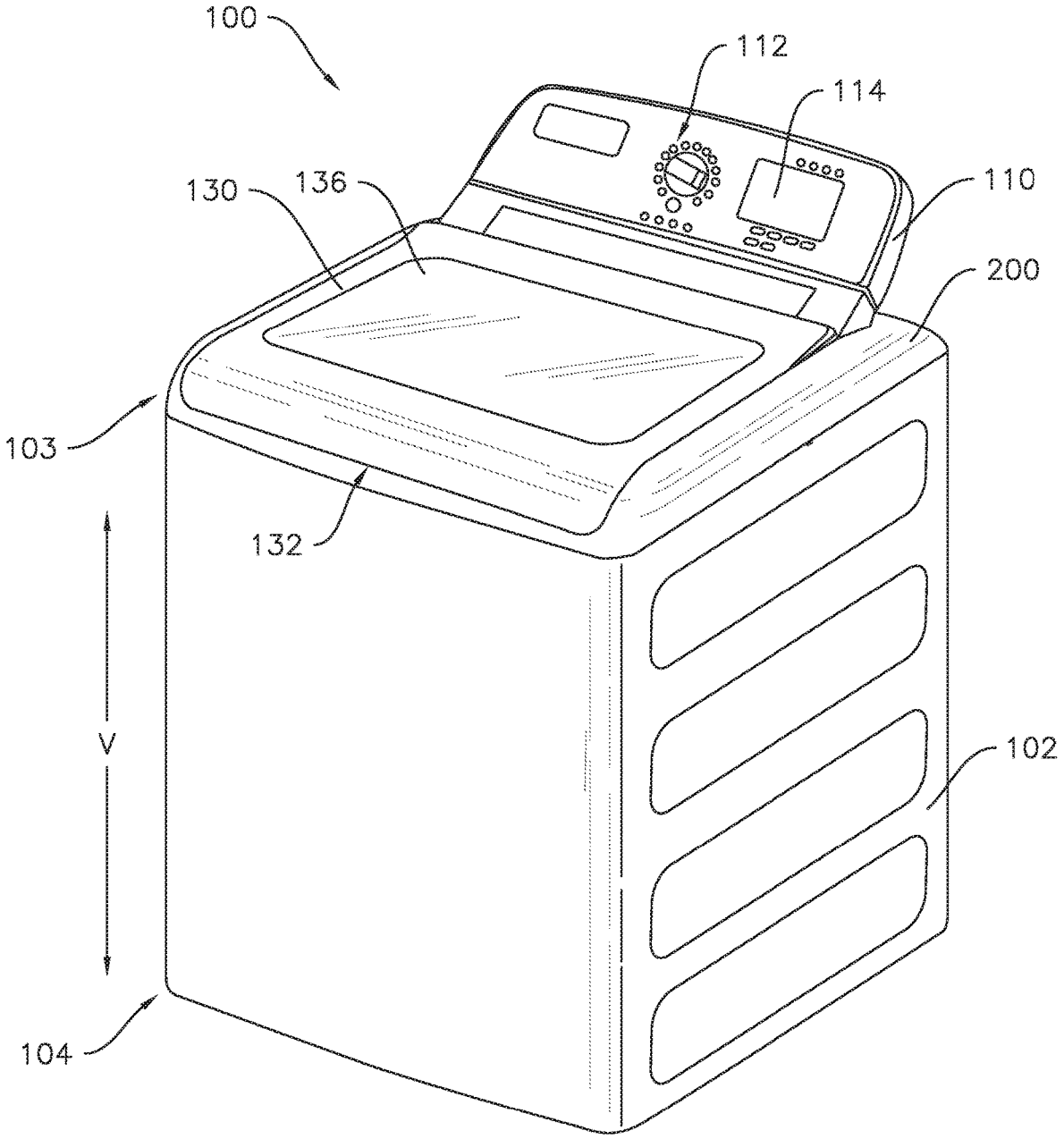
FIG. 1 provides a perspective view of an exemplary washing machine appliance such as may incorporate various embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
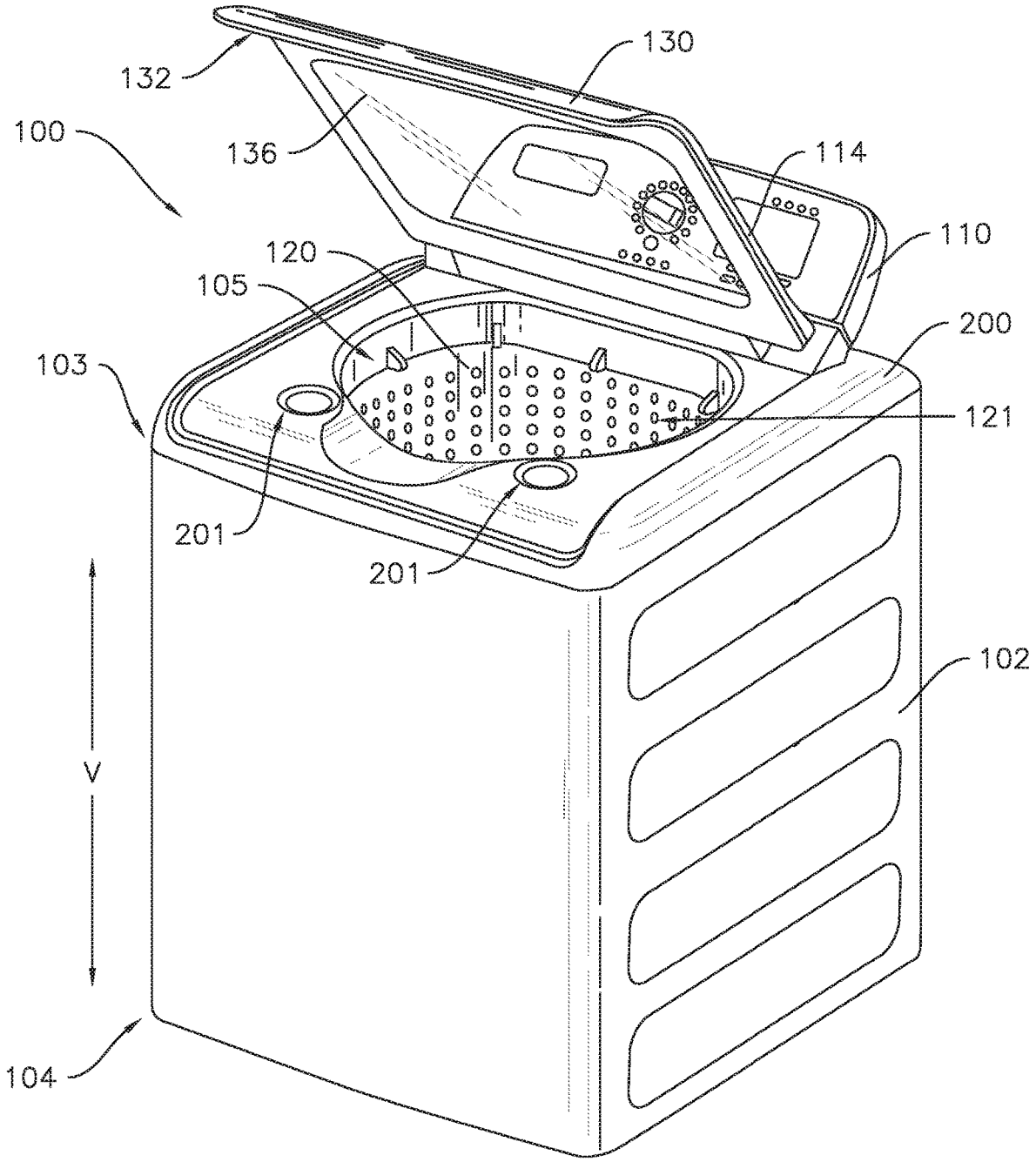
FIG. 2 provides a perspective view of the exemplary washing machine appliance of FIG. 1 with a door of the washing machine appliance shown in an open position.

FIGS. 1 and 2 illustrate an exemplary embodiment of a vertical axis washing machine appliance 100. In FIG. 1, a lid or door 130 is shown in a closed position. In FIG. 2, door 130 is shown in an open position. While described in the context of a specific embodiment of vertical axis washing machine appliance 100, it will be understood that vertical axis washing machine appliance 100 is provided by way of example only. Other washing machine appliances having different configurations, different appearances, and/or different features may also be utilized with the present subject matter as well, e.g., horizontal axis washing machines.

Washing machine appliance 100 has a cabinet 102 that extends between a top 103 and a bottom 104 along a vertical direction V. A wash basket 120 (FIG. 2) is rotatably mounted within cabinet 102. A motor (not shown) is in mechanical communication with wash basket 120 in order to selectively rotate wash basket 120 (e.g., during an agitation or a rinse cycle of washing machine appliance 100). Wash basket 120 defines a wash chamber 121 (FIG. 2) that is configured for receipt of articles for washing. An agitator or impeller (not shown) extends from wash basket 120 into wash chamber 121. The impeller assists agitation of articles disposed within wash chamber 121 during operation of washing machine appliance 100.

Cabinet 102 of washing machine appliance 100 has a top panel 200. Top panel 200 defines an opening 105 (FIG. 2) that permits user access to wash chamber 121 of wash basket 120. Door 130 is rotatably mounted to top panel 200. However, alternatively, door 130 may be mounted to cabinet 102 or any outer suitable support. Door 130 selectively rotates between the closed position shown in FIG. 1 and the open position shown in FIG. 2. In the closed position, door 130 inhibits access to wash chamber 121. Conversely, in the open position, a user can access wash chamber 121. A window 136 in door 130 permits viewing of wash chamber 121 when door 130 is in the closed position, e.g., during operation of washing machine appliance 100. Door 130 also includes a handle 132 that, e.g., a user may pull and/or lift when opening and closing door 130.

Top panel 200 defines at least one hole or opening 201 (FIG. 2). The opening 201 is configured for receipt of a plurality of fluid additives, e.g., detergent, fabric softener, and/or bleach. The opening 201 permits the plurality of fluid additives to pass through top panel 200 to a fluid additive dispenser 210 (e.g., FIG. 3) disposed below top panel 200 along the vertical direction V. Fluid additive dispenser 210 is described in greater detail below.

A control panel 110 with a plurality of input selectors 112 (FIG. 1) extends from top panel 200. Control panel 110 and input selectors 112 collectively form a user interface input for operator selection of machine cycles and features. A display 114 of control panel 130 indicates selected features, a countdown timer, and/or other items of interest to appliance users.

Operation of washing machine appliance 100 is controlled by a controller or processing device (not shown) that is operatively coupled to control panel 110 for user manipulation to select washing machine cycles and features. In response to user manipulation of control panel 110, the controller operates the various components of washing machine appliance 100 to execute selected machine cycles and features.

In an illustrative embodiment, laundry items may be loaded into wash chamber 121 through opening 105, and washing operation may be initiated through operator manipulation of input selectors 112. Wash basket 120 may be filled with water and detergent to form a wash fluid. One or more valves (not shown) can be controlled by washing machine appliance 100 to provide for filling wash basket 120 to the appropriate level for the amount of articles being washed. Once wash basket 120 is properly filled with fluid, the contents of wash chamber 121 are agitated for cleansing of laundry items in wash basket 120.

After the agitation phase of the wash cycle is completed, wash basket 120 may be drained. Laundry articles can then be rinsed by again adding fluid to wash basket 120, and, depending on the particulars of the cleaning cycle selected by a user, the impeller may again provide agitation within wash chamber 121. One or more spin cycles may also be used. In particular, a spin cycle may be applied after the wash cycle and/or after the rinse cycle in order to wring wash fluid from the articles being washed. During a spin cycle, wash basket 120 is rotated at relatively high speeds. After articles disposed in wash basket 120 are cleaned and/or washed, the user can remove the articles from wash basket 120, e.g., by reaching into wash chamber 121 through opening 105.

Figure 3:
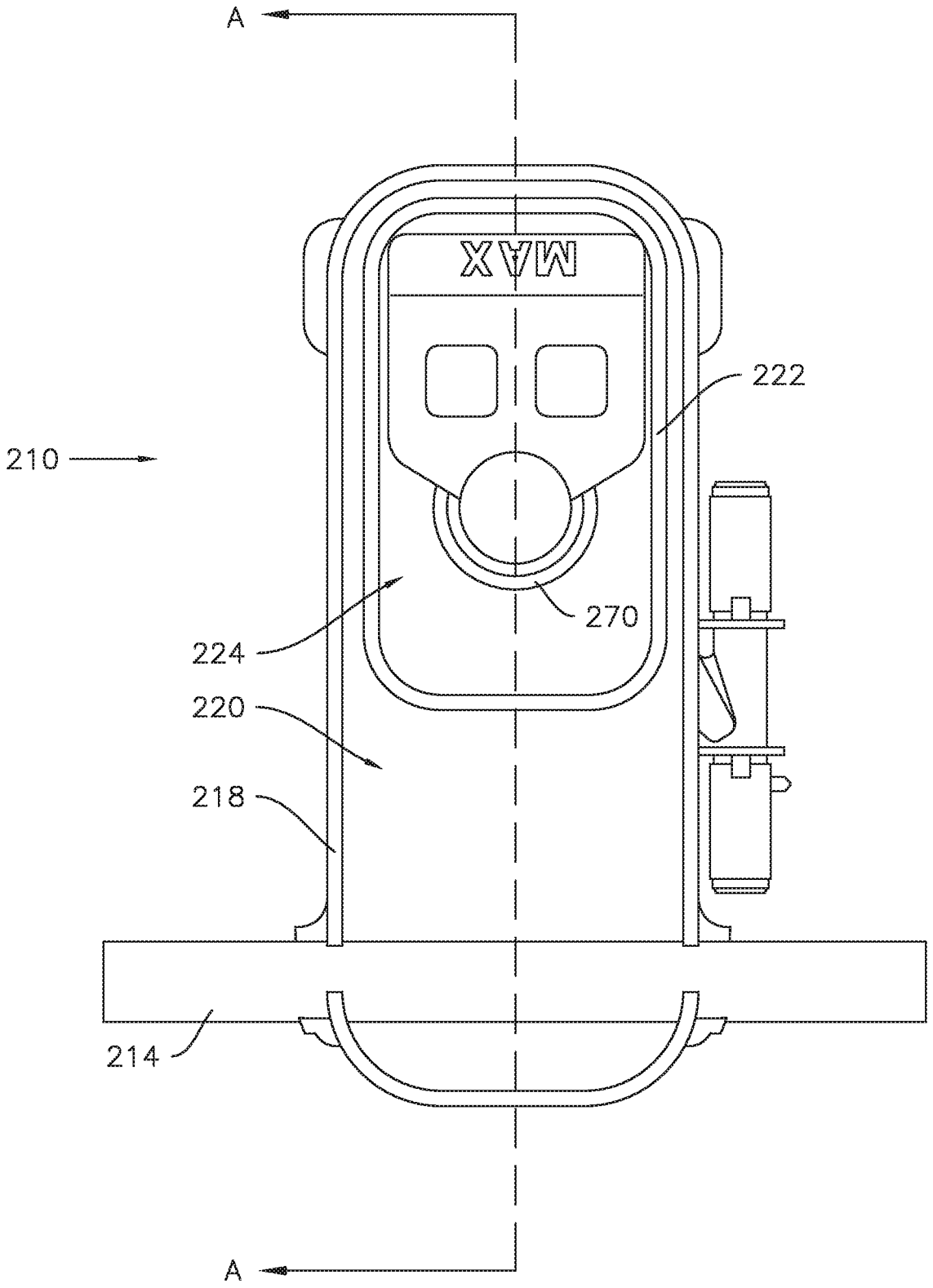
FIG. 3 provides a top-down overhead view of an exemplary fluid additive dispenser for a washing machine appliance according to one or more exemplary embodiments of the present subject matter.

FIG. 3 is a top-down overhead view of an exemplary embodiment of a fluid additive dispenser 210. As used herein, the terms "additive" or "fluid additive" generally refer to fluids other than water, such as detergent, bleach, fabric softener, perfumes, and/or other such laundry treatment chemicals. The fluid additive dispenser 210 may be positioned at the opening 201 of the top panel 200, e.g., the open top of the fluid additive dispenser 210 may be aligned with and positioned below the opening 201. As an example, a user can pour an additive such as detergent through the opening 201 such that the additive passes into fluid additive dispenser 210.

Fluid additive dispenser 210 may be constructed of any suitable material. For example, fluid additive dispenser 210 may be constructed of a plastic, a metal, or a combination of materials.

As may be seen in FIG. 3, a water conduit 214 may be coupled to and/or in fluid communication with the fluid additive dispenser 210. Water conduit 214 is in fluid communication with a water source (not shown), e.g., using a hose or other conduit. The water conduit 214 may include one or more outlet ports 216 (FIGS. 4 and 5) to direct a selective flow of water into the fluid additive dispenser 210.

The fluid additive dispenser 210 may include a first cup 218 and a second cup 220. The second cup 220 may be positioned within the first cup 218, e.g., the second cup 220 may be surrounded by the first cup on at least five sides, such as all six sides. The first cup 218 may define a first reservoir 220 for a first additive and an outlet 234 in fluid communication with the wash basket 120. The second cup 222 may define a second reservoir 224 for a second additive. The second reservoir 224 may be in fluid communication with the wash basket 120 via the outlet 234 of the first cup 218.

The second reservoir 224 may be separated from the first reservoir 220, e.g., the second reservoir 224 may be defined by a distinct structure from the structure which defines the first reservoir 220. For example, as may be seen in FIGS. 3 through 5, the second reservoir 224 may be separate and distinct from the first reservoir 220 in that the second cup 222 which defines the second reservoir 224 is a separate and distinct structure from the first cup 218 which defines the first reservoir 220. For example, there are no common walls which define a portion of each of the first reservoir 220 and the second reservoir 224.

Figure 4:
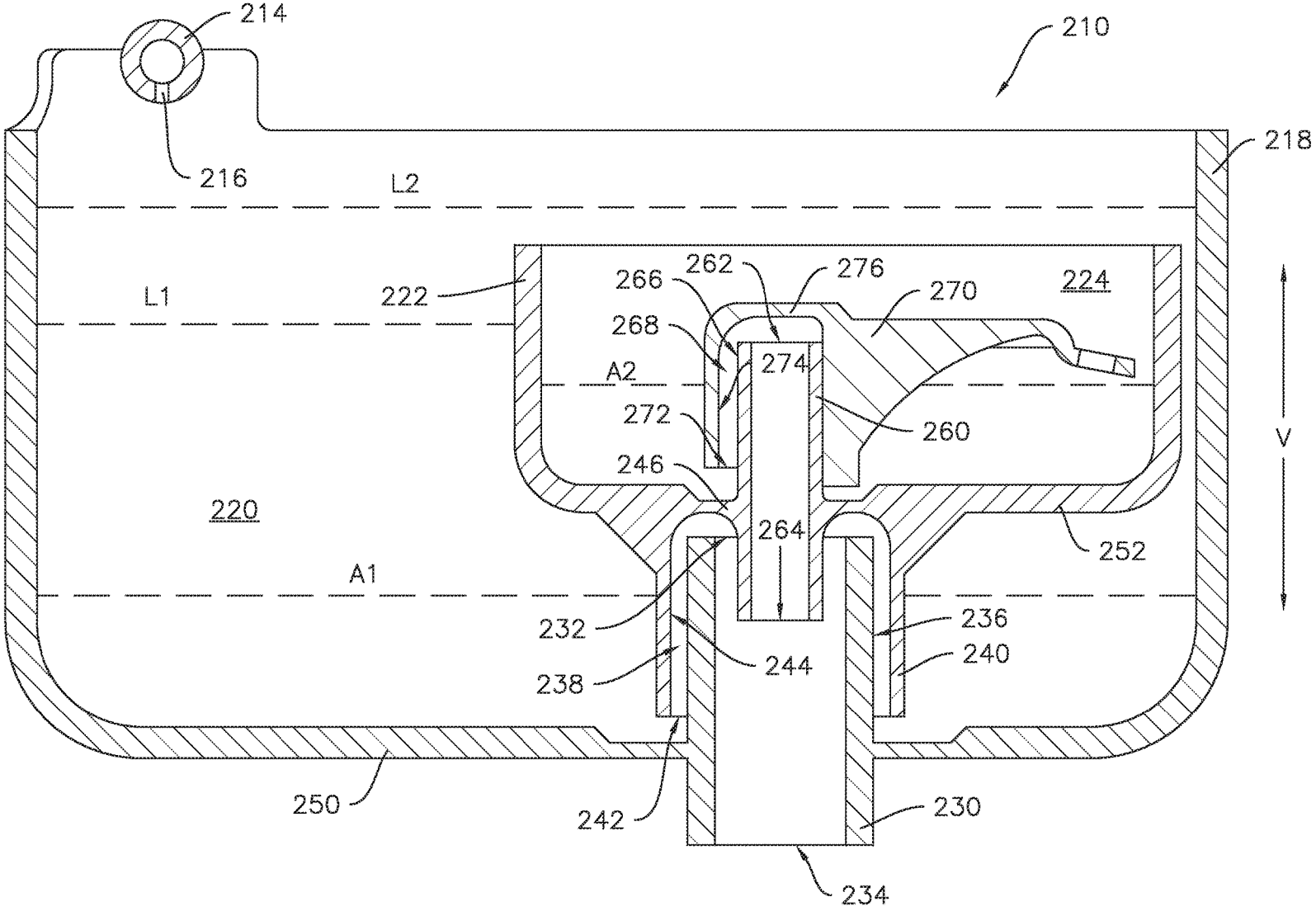
FIG. 4 provides a section view of the fluid additive dispenser of FIG. 3.
Figure 5:
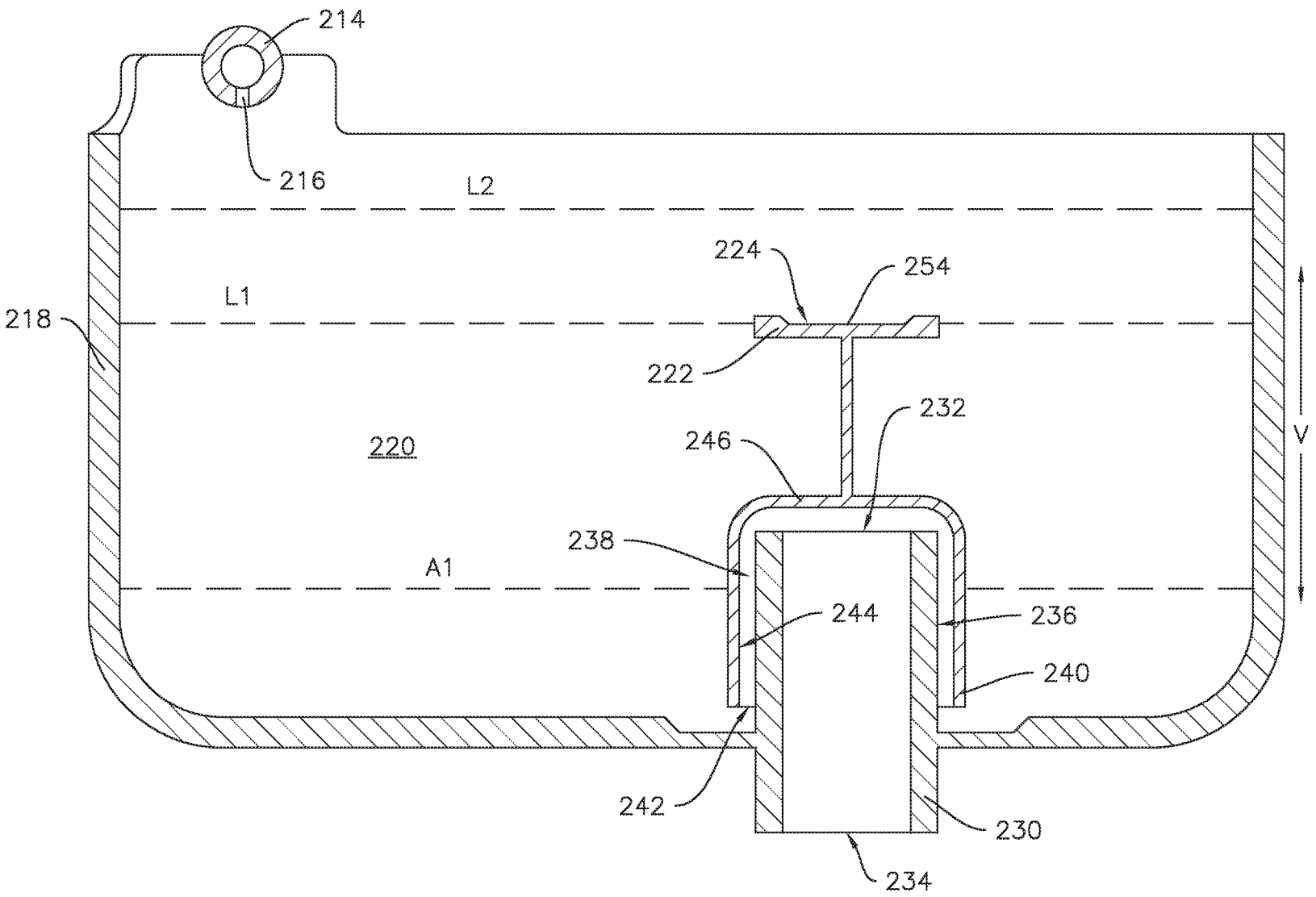
FIG. 5 provides a section view of a fluid additive dispenser for a washing machine appliance according to an additional exemplary embodiment of the present subject matter.

In at least some embodiments, e.g., as illustrated in FIGS. 4 and 5, the outlet 234 of the first cup 218 may be a siphon tube outlet 234. For example, the fluid additive dispenser 210 may include a siphon tube 230 extending through a bottom wall 250 of the first cup 218 and a siphon cap 240 positioned over and around the siphon tube 230. In such embodiments, the siphon tube 230 may include a siphon tube inlet 232 and a siphon tube outlet 234 spaced apart along the vertical direction V with siphon tube outlet 234 vertically below siphon tube inlet 232. Siphon tube outlet 234 may preferably be positioned for directing additive and/or water from the fluid additive dispenser 210 into the wash basket 120 and/or the wash tub.

As mentioned above, the fluid additive dispenser 210 is in fluid communication with wash basket 120 for adding fluids, e.g. fabric softener, bleach, scented additives such as perfumes or essential oils, and/or any other desired additives to wash basket 120. In particular, fluid additive dispenser 210 may include only one outlet in fluid communication with the wash basket 120, e.g., siphon tube outlet 234. Thus, in some embodiments, the fluid additive dispenser 210 is in fluid communication with the wash basket 120 only via the siphon tube outlet 234. For example, the outlet 234 may be the only point of egress for liquid from the first cup 218 and from the second cup 222 into the wash basket 120.

The siphon cap 240 may be positioned above and around the siphon tube 230 such that an inlet 242 of the siphon cap 240 is positioned below the siphon tube inlet 232 along the vertical direction V and a top wall 246 of the siphon cap 240 is positioned above the siphon tube inlet 232 along the vertical direction V. In this arrangement, siphon cap 240 and siphon tube 230 are juxtaposed along the vertical direction V such that they are partially overlapped vertically, and a narrow gap remains therebetween, e.g., defining a siphon passage 238 between an inner surface 244 of the siphon cap 240 and an outer surface 236 of the siphon tube 230 for siphoning liquid out of the first reservoir 220 from the inlet 242 of the siphon cap 240 to an inlet 232 of the siphon tube 230. In some exemplary embodiments, siphon tube 230 and siphon cap 240 may be cylindrical and collectively define a longitudinal direction, a radial direction perpendicular to the longitudinal direction, and a circumferential direction that extends around a longitudinal axis of the cylindrical siphon tube 230 and siphon cap 240. In such embodiments, the width of the siphon passage 238 defined between the inner surface 244 of the siphon cap 240 and the outer surface 236 of the siphon tube 230 may lie along the radial direction.

In some embodiments, the second cup 222 may be positioned above the outlet 234. For example, the second cup 222, or at least a portion thereof, may be positioned directly above the outlet 234 along the vertical direction V. Further, in at least some embodiments, the siphon cap 240 may be integrally formed with the second cup 222. For example, the top wall 246 of the siphon cap 240 may be a portion of a bottom wall 252 of the second cup 222.

In at least some embodiments, the fluid additive dispenser 210 may define a first volume and a second volume greater than the first volume. For example, as illustrated in FIGS. 4 and 5, the first volume may correspond to filling the fluid additive dispenser 210 to a first level L1 and the second volume may correspond to filling the fluid additive dispenser 210 to a second level L2. The fluid additive dispenser 210 may be configured such that liquid flows from the fluid additive dispenser 210 into the wash basket 120 through the first cup 218 when the fluid additive dispenser 210 is filled to the first volume, and liquid flows from the fluid additive dispenser 210 into the wash basket 120 through the second cup 222 when the fluid additive dispenser 210 is filled to the second volume.

Still with reference to FIGS. 4 and 5, siphon passage 238 regulates the flow of the first fluid additive out of the first reservoir 220. As an example, an additive may be placed in the first reservoir 220 prior to the initiation of a wash cycle. Such additive can be stored in the first reservoir 220 up to about first additive level A1, which is below siphon tube inlet 232, and will flow by gravity to siphon cap inlet 242, but will not reach siphon tube inlet 232. During operation of the wash cycle, and in some exemplary embodiments, at a particular desired step of the wash cycle, which may depend on the type of additive, a flow of water into the fluid additive dispenser 210 can be initiated through the outlet(s) 216 of the water conduit 214. Such water can mix with fluid additive within the first reservoir 220 and fill the first reservoir 220 to a particular level, such as at or about first siphon level L1, at which point a siphon is formed between inlet 242 in siphon cap 240 and siphon tube inlet 232 along siphon passage 238, so that the first reservoir 220 is at least partially drained of the water and fluid additive solution. In other words, when the first reservoir 220 is filled such that the liquid level reaches the first siphoning level L1, liquid will begin to flow along siphon passage 238 from siphon cap inlet 242 to siphon tube inlet 232. Thus, when the fluid additive dispenser 210 is filled to the first volume, e.g., to the first siphoning level L1, liquid flows from the fluid additive dispenser 210 into the wash basket 120 from the first cup 218 via the siphon passage 238.

In some embodiments, e.g., as illustrated in FIG. 4, liquid may flow from the fluid additive dispenser 210 into the wash basket 120 through the second cup 222 via a second siphon passage 268 when the fluid additive dispenser 210 is filled to the second volume. For example, as illustrated in FIG. 4, the siphon tube 230 may be a first siphon tube, the siphon cap 240 may be a first siphon cap, and the fluid additive dispenser 210 may further include a second siphon tube 260 extending through the bottom wall 252 of the second cup 222 and a second siphon cap 270 positioned over and around the second siphon tube 260. Similar to the first siphon tube 230 and the first siphon cap 240 which are described above, the second siphon tube 260 may include a second siphon tube inlet 262 and a second siphon tube outlet 264 spaced apart along the vertical direction V with the second siphon tube outlet 264 vertically below the second siphon tube inlet 262. The second siphon tube outlet 264 may preferably be positioned for directing additive and/or water from the second reservoir 224 directly (e.g., not via the first reservoir 220) into the first siphon tube 230, and from the first siphon tube 230 into the wash basket 120 and/or the wash tub via the first siphon tube outlet 234. For example, the second siphon tube outlet 264 may be positioned between the first siphon tube inlet 232 and the first siphon tube outlet 234, such as below the first siphon tube inlet 232 along the vertical direction V and above the first siphon tube outlet 234 along the vertical direction V.

The second siphon cap 270 may be positioned above and around the second siphon tube 260 such that an inlet 272 of the second siphon cap 270 is positioned below the second siphon tube inlet 262 along the vertical direction V and a top wall 276 of the second siphon cap 270 is positioned above the second siphon tube inlet 262 along the vertical direction V. In this arrangement, the second siphon cap 270 and the second siphon tube 260 are juxtaposed along the vertical direction V such that they are partially overlapped vertically, and a narrow gap remains therebetween, e.g., defining a second siphon passage 268 between an inner surface 274 of the second siphon cap 270 and an outer surface 266 of the second siphon tube 260 for siphoning liquid out of the second reservoir 224 from the inlet 272 of the second siphon cap 270 to an inlet 262 of the second siphon tube 260. In some exemplary embodiments, the second siphon tube 260 and the second siphon cap 270 may be cylindrical and collectively define a longitudinal direction, a radial direction perpendicular to the longitudinal direction, and a circumferential direction that extends around a longitudinal axis of the cylindrical second siphon tube 260 and second siphon cap 270. In such embodiments, the width of the second siphon passage 268 defined between the inner surface 274 of the second siphon cap 270 and the outer surface 266 of the second siphon tube 260 may lie along the radial direction.

As mentioned above, the second volume may correspond to filling the fluid additive dispenser 210 to the second level L2. In embodiments including the second siphon tube 260 and the second siphon cap 270, a second additive may be placed in the second reservoir 224 prior to the initiation of a wash cycle. Such second additive can be stored in the second reservoir 224 up to about second additive level A2, which is below the second siphon tube inlet 262, and will flow by gravity to the second siphon cap inlet 272, but will not reach the second siphon tube inlet 262. During operation of the wash cycle, and in some exemplary embodiments, at a particular desired step of the wash cycle, which may depend on the type of additive, a flow of water into the fluid additive dispenser 210 can be initiated through the outlet(s) 216 of the water conduit 214. When such water reaches a particular level, such as at or about second level L2, which is a second siphon level in the example embodiment illustrated in FIG. 4 which includes the second siphon tube 260 and the second siphon cap 270, the water may flow into the second reservoir 224, mix with the second additive therein, and form a siphon between inlet 272 in the second siphon cap 270 and siphon tube inlet 262 along the second siphon passage 268, so that the second reservoir 224 is at least partially drained of the water and fluid additive solution. In other words, when the fluid additive dispenser 210 is filled such that the liquid level reaches the second siphoning level L2, liquid will begin to flow along the second siphon passage 268 from siphon cap inlet 272 to siphon tube inlet 262. Thus, when the fluid additive dispenser 210 is filled to the second volume, e.g., to the second siphoning level L2, liquid flows from the fluid additive dispenser 210 into the wash basket 120 through the second cup 220 via the second siphon passage 268.

In some embodiments, e.g., as illustrated in FIG. 5, liquid may flow from the fluid additive dispenser 210 into the wash basket 120 through the second cup 222 via the first reservoir 220 and the siphon passage 238 when the fluid additive dispenser 210 is filled to the second volume. For example, in such embodiments, the second additive may be stored in a portion of the second cup 222, such as in a recess 254 defined therein. In some embodiments, such as the example embodiment illustrated by FIG. 5, the second reservoir 224 may be defined by the recess 254. When the fluid additive dispenser 210 is filled to the second volume, e.g., to a height at the second level L2 as illustrated in FIG. 5, the water may flow into the second cup 222 and mix with the second additive therein. Further, at the second level L2, the water may flush out the second cup 222, such that the water and second additive mixture from the second reservoir 224 flows into the first reservoir 220 and to the outlet 234 via the first siphon passage 238.

Thus, the fluid additive dispenser 210 may provide dispensing of multiple additives, such as a first additive in the first reservoir 220 and a second additive in the second reservoir 224, from a single dispenser and via a single outlet. Additionally, the fluid additive dispenser 210 may provide the multiple additives with a time delay, where the first additive is dispensed from the first reservoir 220 at an earlier time when the fluid additive dispenser is filled to the first siphoning level L1, and the second additive is dispensed from the second reservoir 224 at a subsequent time after continuing to flow water into in the fluid additive dispenser 210 until the fluid additive dispenser 210 is filled to the second level L2. Also, the fluid additive dispenser 210 may provide multiple additives with only a single water supply or inlet. For example, the fluid additive dispenser 210 and related washing machine appliances may include only a single water line in fluid communication with both the first cup 218 and the second cup 222. For example, the single water line may be the only water supply to the fluid additive dispenser 210.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet defining a vertical direction, the cabinet having a top panel that defines an opening;

a wash tub mounted within the cabinet and configured for containing fluid during operation of the washing machine appliance;

a wash basket rotatably mounted within the wash tub;

a fluid additive dispenser positioned adjacent the wash tub and the wash basket, the fluid additive dispenser comprising:

a first cup defining a first reservoir for a first additive and an outlet in fluid communication with the wash basket; and a second cup defining a second reservoir for a second additive, the second cup disposed within the first cup, the second reservoir separated from the first reservoir and in fluid communication with the wash basket via the outlet of the first cup, the second cup comprising a second outlet defined through a bottom wall of the second cup, wherein the second outlet defined through the bottom wall of the second cup is upstream of the outlet of the first cup such that the second cup is in fluid communication with the wash basket via the second outlet defined through the bottom wall of the second cup and the outlet of the first cup.

2. The washing machine appliance of claim 1, wherein the second cup is positioned above the outlet.

3. The washing machine appliance of claim 1, wherein the outlet of the first cup is the only point of egress for liquid from the first cup and the second cup into the wash basket.

4. The washing machine appliance of claim 1, wherein the first cup further comprises a siphon tube, wherein the outlet is a siphon tube outlet of the siphon tube, the siphon tube extending from a siphon tube inlet to the siphon tube outlet.

5. The washing machine appliance of claim 4, further comprising a siphon cap surrounding the siphon tube such that a siphon passage is defined between an inner surface of the siphon cap and an outer surface of the siphon tube for siphoning liquid from the first reservoir to the siphon tube inlet, wherein the siphon cap is integrally formed with the second cup.

6. The washing machine appliance of claim 1, wherein the fluid additive dispenser defines a first volume and a second volume greater than the first volume, wherein liquid flows from the fluid additive dispenser into the wash basket through the first cup when the fluid additive dispenser is filled to the first volume, and wherein liquid flows from the fluid additive dispenser into the wash basket through the second cup when the fluid additive dispenser is filled to the second volume.

7. The washing machine appliance of claim 1, further comprising a single water line in fluid communication with both the first cup and the second cup.

8. The washing machine appliance of claim 1, wherein the second cup and the second outlet collectively define at least a portion of a fluid flow path from the second reservoir to the wash basket, wherein the fluid flow path from the second reservoir to the wash basket is isolated from the first reservoir.

9. The washing machine appliance of claim 4, wherein the siphon tube of the first cup is a first siphon tube, the siphon tube inlet is a first siphon tube inlet, and the siphon tube outlet is a first siphon tube outlet, further comprising a second siphon tube extending through the bottom wall of the second cup whereby the siphon tube defines the second outlet, the second siphon tube extending from a second siphon tube inlet to a second siphon tube outlet, the second siphon tube disposed partially within the first siphon tube.

10. The washing machine appliance of claim 9, wherein the second siphon tube outlet is positioned below the first siphon tube inlet and above the first siphon tube outlet.

11. A fluid additive dispenser for a washing machine appliance, the fluid additive dispenser comprising:

a first cup defining a first reservoir for a first additive and an outlet in fluid communication with a wash basket of the washing machine appliance; and a second cup defining a second reservoir for a second additive, the second cup disposed within the first cup, separated from the first cup, the second reservoir separated from the first reservoir and in fluid communication with the wash basket via the outlet of the first cup, the second cup comprising a second outlet defined through a bottom wall of the second cup, wherein the second outlet defined through the bottom wall of the second cup is upstream of the outlet of the first cup such that the second cup is in fluid communication with the wash basket via the second outlet defined through the bottom wall of the second cup and the outlet of the first cup.

12. The fluid additive dispenser of claim 11, wherein the second cup is positioned above the outlet.

13. The fluid additive dispenser of claim 11, wherein the outlet of the first cup is the only point of egress for liquid from the first cup and the second cup into the wash basket.

14. The fluid additive dispenser of claim 11, wherein the first cup further comprises a siphon tube, wherein the outlet is a siphon tube outlet of the siphon tube, the siphon tube extending from a siphon tube inlet to the siphon tube outlet.

15. The fluid additive dispenser of claim 14, further comprising a siphon cap surrounding the siphon tube such that a siphon passage is defined between an inner surface of the siphon cap and an outer surface of the siphon tube for siphoning liquid from the first reservoir to the siphon tube inlet, wherein the siphon cap is integrally formed with the second cup.

16. The fluid additive dispenser of claim 11, wherein the fluid additive dispenser defines a first volume and a second volume greater than the first volume, wherein liquid flows from the fluid additive dispenser through the first cup when the reservoir is filled to the first volume, and wherein liquid flows from the fluid additive dispenser through the second cup when the reservoir is filled to the second volume.

17. The fluid additive dispenser of claim 11, further comprising a single water line in fluid communication with both the first cup and the second cup.

18. The fluid additive dispenser of claim 11, wherein the second cup and the second outlet collectively define at least a portion of a fluid flow path from the second reservoir to the wash basket, wherein the fluid flow path from the second reservoir to the wash basket is isolated from the first reservoir.

19. The fluid additive dispenser of claim 14, wherein the siphon tube of the first cup is a first siphon tube, the siphon tube inlet is a first siphon tube inlet, and the siphon tube outlet is a first siphon tube outlet, further comprising a second siphon tube extending through the bottom wall of the second cup whereby the siphon tube defines the second outlet, the second siphon tube extending from a second siphon tube inlet to a second siphon tube outlet, the second siphon tube disposed partially within the first siphon tube.

20. The fluid additive dispenser of claim 19, wherein the second siphon tube outlet is positioned below the first siphon tube inlet and above the first siphon tube outlet.

* * * * *